US007096697B2

(12) United States Patent
Keightly

(10) Patent No.: US 7,096,697 B2
(45) Date of Patent: Aug. 29, 2006

(54) ELECTRONIC DEADBOLT LOCK ARRANGEMENT

(76) Inventor: Kym John Keightly, 5 Vincenzo Street, Fairview Park, South Australia (AU) 5126

( * ) Notice: Subject to any disclaimer, the term of this patent is extended or adjusted under 35 U.S.C. 154(b) by 0 days.

(21) Appl. No.: 10/514,518

(22) PCT Filed: May 16, 2003

(86) PCT No.: PCT/AU03/00593

§ 371 (c)(1),
(2), (4) Date: Nov. 15, 2004

(87) PCT Pub. No.: WO03/097969

PCT Pub. Date: Nov. 27, 2003

(65) Prior Publication Data

US 2005/0172685 A1 Aug. 11, 2005

(30) Foreign Application Priority Data

May 16, 2002 (AU) ..... PS 2328

(51) Int. Cl.
*E05B 47/00* (2006.01)

(52) U.S. Cl. ..... 70/279.1; 70/222; 70/280; 292/142; 292/144

(58) Field of Classification Search ..... 70/188, 70/189, 222, 257, 280–282, 279.1, 278.3, 70/278.7, 223, 422, 218, 149, 472, 283, 277, 70/283.1; 292/142, 144
See application file for complete search history.

(56) References Cited

U.S. PATENT DOCUMENTS

| | | | | |
|---|---|---|---|---|
| 1,374,908 | A * | 4/1921 | Davenport et al. | 70/222 |
| 1,560,503 | A * | 11/1925 | Doenges | 70/222 |
| 1,657,402 | A * | 1/1928 | Kenworthy et al. | 70/252 |
| 4,429,556 | A * | 2/1984 | Kambic | 70/149 |
| 4,438,962 | A * | 3/1984 | Soloviff et al. | 292/144 |
| 4,633,688 | A * | 1/1987 | Beudat et al. | 70/279.1 |
| 5,027,629 | A * | 7/1991 | Liu | 70/277 |
| 5,199,288 | A * | 4/1993 | Merilainen et al. | 70/279.1 |
| 5,816,085 | A * | 10/1998 | Winardi et al. | 70/283 |
| 5,987,945 | A * | 11/1999 | Ruano Aramburu | 70/277 |
| 6,286,347 | B1 * | 9/2001 | Frolov | 70/472 |
| 6,543,264 | B1 * | 4/2003 | Frolov | 70/222 |
| 6,651,468 | B1 * | 11/2003 | Aramburu et al. | 70/222 |
| 6,935,149 | B1 * | 8/2005 | Peng et al. | 70/472 |
| 2003/0071471 | A1 * | 4/2003 | Lu | 292/144 |

* cited by examiner

*Primary Examiner*—Lloyd A. Gall
(74) *Attorney, Agent, or Firm*—John E. Vandigriff

(57) ABSTRACT

An electronic deadbolt lock arrangement including a lock having a bolt movable between locked and unlocked conditions. The lock includes a manual control and a power drive to operate the lock that are connected by a decouplable transmission enabling the lock to be operated by either the manual control or the power drive. The transmission includes two concentric cylinders that can be locked or unlocked for relative rotational movement, with manual operation of the lock decoupling the power drive. A biased pin engages co-operating apertures in the cylinders to lock the two cylinders to each other. A cam operated by the manual drive acts against the pin to cause the two cylinders to be decoupled.

14 Claims, 14 Drawing Sheets

ELECTRONIC DEADBOLT LOCK ARRANGEMENT

FIELD OF THE INVENTION

The present invention is directed to a deadbolt. In particular the invention is directed to a deadbolt lock arrangement that is operable both manually and electronically.

BACKGROUND OF THE INVENTION

Traditionally secure locking systems such as deadbolts have been operated and controlled manually. However, the use of electronic systems for the control and operation of locks is becoming increasingly common. The present invention is directed to an arrangement that permits the electronic and manual control of the lock operation to be separated to allow manual operation of the lock independently of the electronic drive system for the lock. The lock of the present invention is useful in situations where an electronic controller is temporarily unavailable, for example where a controller has been lost, misplaced or damaged.

SUMMARY OF THE INVENTION

Therefore, according to a first aspect of the present invention, although this need not be the broadest, nor indeed the only aspect of the invention there is provided an electronic deadbolt lock arrangement including:

- a lock having a bolt movable between locked and unlocked conditions, the lock having a manual control means serving to operate the lock between said locked and unlocked conditions;
- a power drive coupled by a transmission to the manual control means whereby the lock is operated between the locked and unlocked conditions in response to operation of the power drive;
- a transmission means coupling the manual control means and the power drive whereby the lock moves between said locked and unlocked conditions;
- the transmission means operable to decouple the power drive from the manual control means to enable the lock to be operated by the manual control means independently of the power drive.

In preference said manual control means is a thumb turn.

In preference said manual control means is a key.

In preference said power drive is an electric motor.

In such a manner the electronic deadbolt lock arrangement of the invention may be used to lock or unlock a door by operation of a key, a thumb turn or an electric motor.

In preference said transmission means includes an inner and outer concentric rotatable cylinders.

In preference the two cylinders are biased into a coupled position by biasing means and are decoupled by a centrally located cam acting on a pin engaging mechanism urging a pin out of engagement to thereby decouple the cylinders.

In preference said inner and outer cylinders may be coupled and de-coupled by said pin extending from one cylinder engaging an aperture in the other cylinder.

In preference said pin extends from and is biased from said outer into said inner cylinder.

In preference said lock further includes a projection adapted to engage said pin, said projection operable by a cam to move the pin out of said inner cylinder to cause a decoupling thereof.

In preference said cam is mounted on a drive shaft passing axially through said cylinders.

In preference said inner cylinder is connected to a rack and gear mechanism whereby rotation of the inner cylinder serves to move said bolt between locked and unlocked positions, said outer cylinder is operatively connected to a motor serving as a power drive that rotates the outer cylinder.

The electric motor rotates in a clockwise or anti-clockwise direction to extend or retract a lock bolt.

However when operating the lock bolt with the key or thumb turn the transmission can decouple the electric motor so that rotation of the lock bolt can occur independently of the electric motor.

In one form of the invention the transmission takes the form of a pair of concentric cylinders movable over one another that may be coupled and de-coupled by a pin extending from one cylinder engaging an aperture in the second cylinder.

Preferably there are two or more manual control means.

In preference the thumb turn is coupled through a transmission to a rotatable shaft, said transmission multiplying the relative rotation of the thumb turn applied to the shaft.

In preference said key operates a lock barrel said lock barrel operatively connected to the bolt through a coupling enabling the key to operate the bolt only when fully inserted into said lock barrel.

In preference said biased coupling includes a biased connector adapted to engage a coupling element, said element operatively connected to said bolt.

Preferably said connector includes a cavity adapted to be engaged by a projection of said connector, the cavity of a size and shape to be engageable by said projection regardless of the relative rotational position of said connector and said coupling element.

DESCRIPTION OF DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENT

Figure 1:
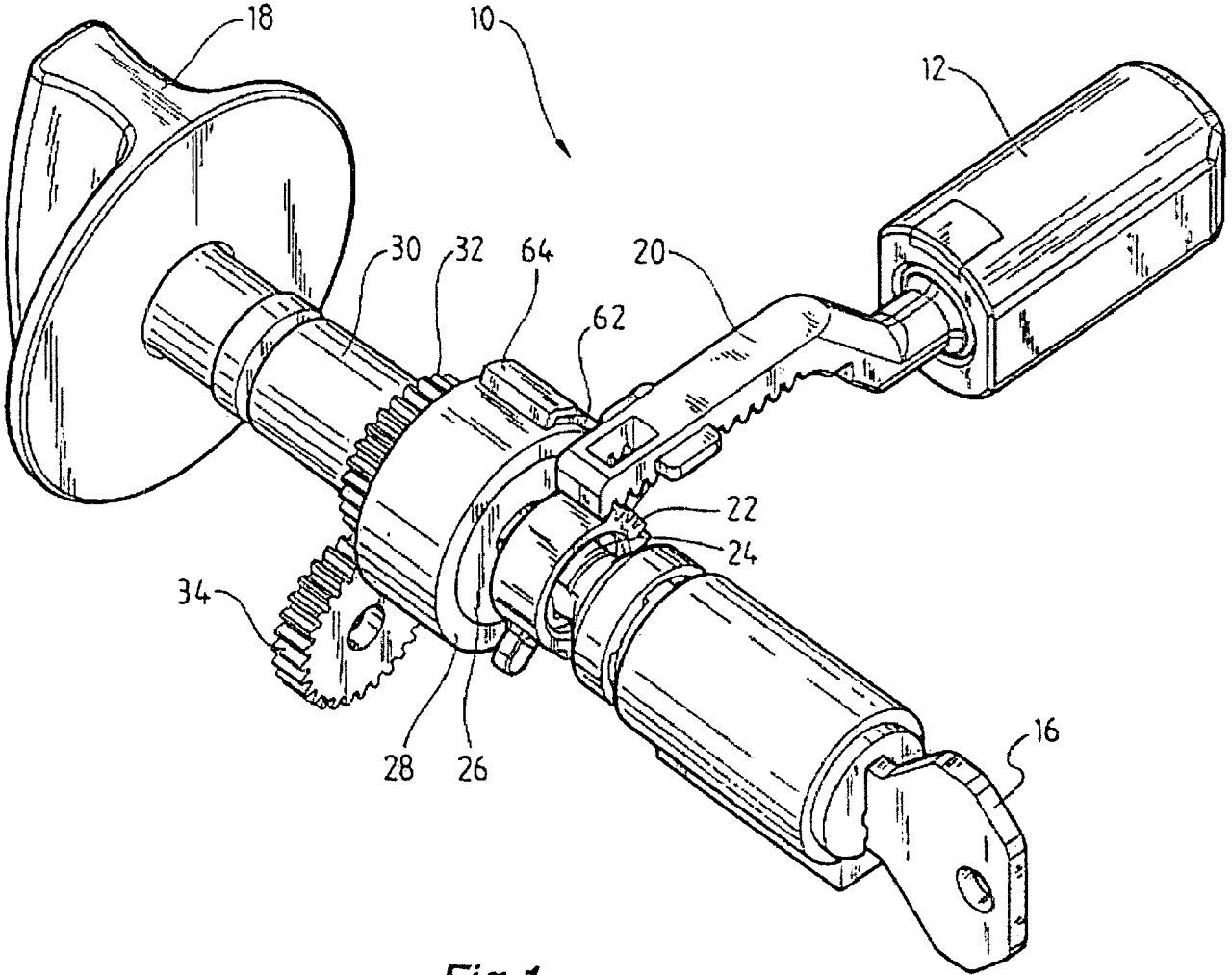
FIG. 1 represents schematically an upper perspective representation of a lock bolt contained in a lock housing in accordance with the present invention.
Figure 2:
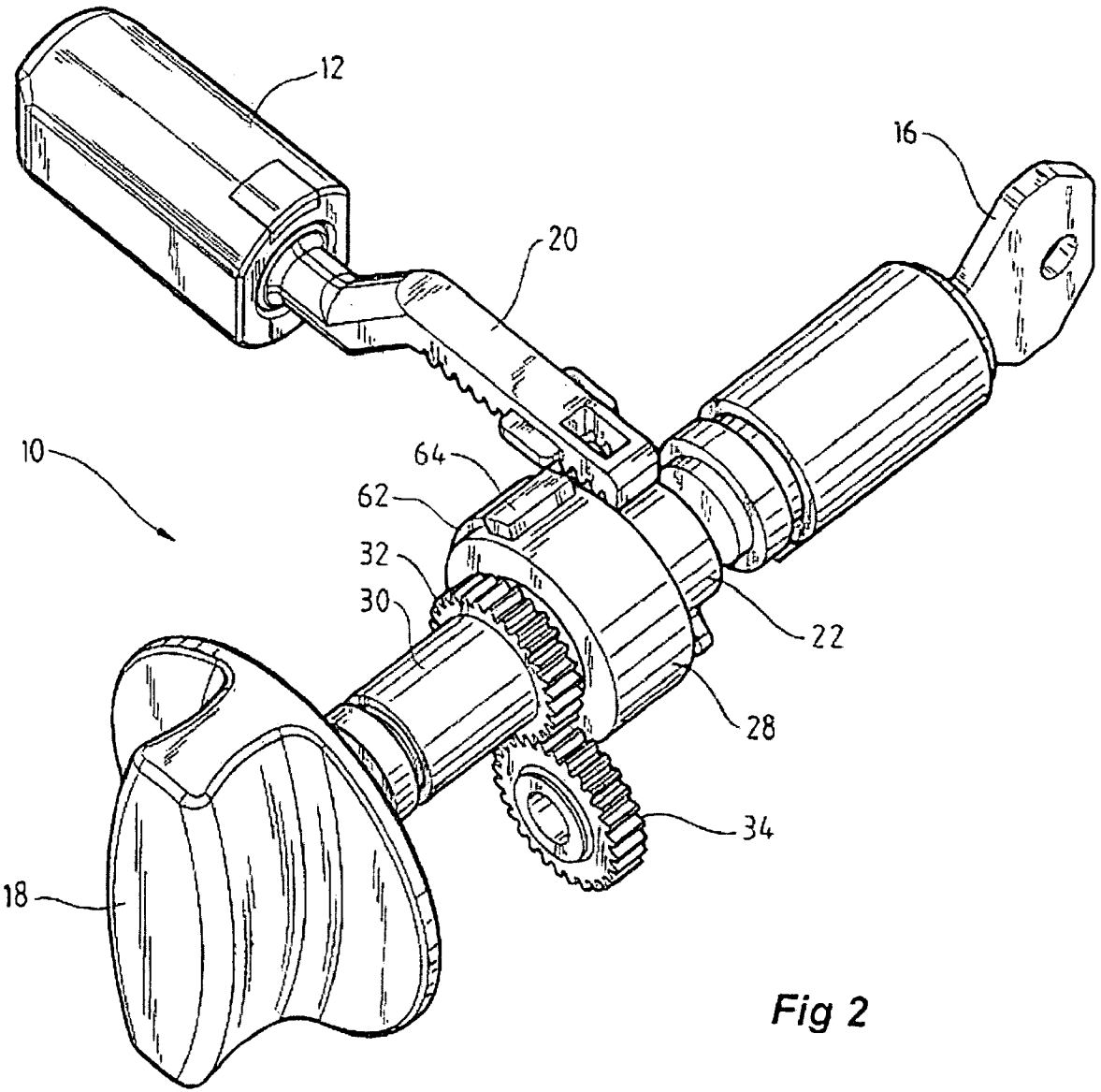
FIG. 2 represents schematically an alternative perspective representation of the lock of FIG. 1.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The drawings illustrate a door lock 10 incorporating a locking mechanism in accordance with the invention. The lock 10 is adapted for both manual and electronic operation and includes a lock bolt 12 operatively attached to a locking mechanism (discussed later) located in a generally circular housing 14. The lock 10 is adapted to be fixed to a door and the lock 10 may be operated by rotation of either of a key 16 in the lock, a thumb turn 18 disposed on an opposite side of the door to the key, or by remote controlled electronic means (not shown).

In broad outline the lock bolt 12 is attached at one end to a rack 20. The rack 20 is driven by the locking mechanism and either extends the locking bolt 12 to thereby effecting a locking action, or retracts the lock bolt 12 thereby releasing the lock 10.

Figure 3:
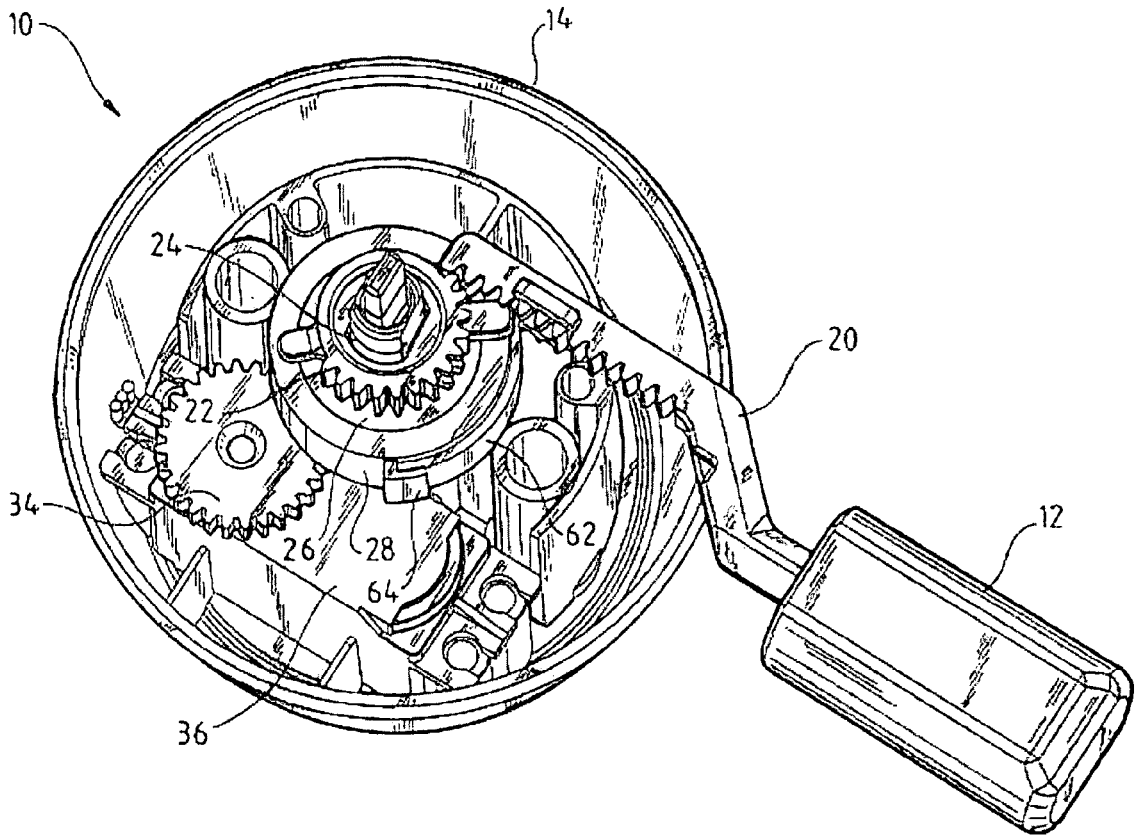
FIG. 3 illustrates the lock bolt of FIG. 1 within a housing.
Figure 4:
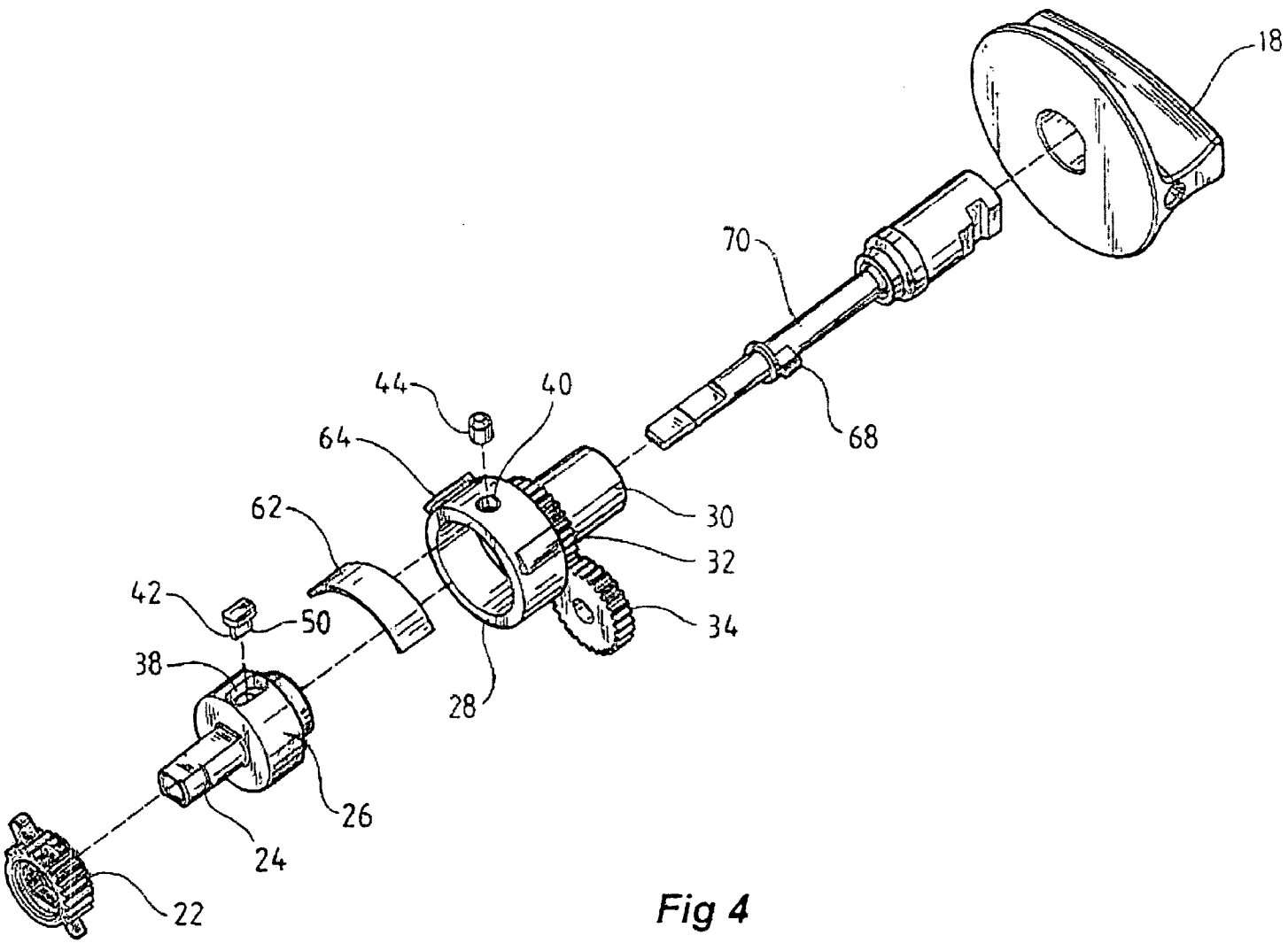
FIG. 4 illustrates in exploded schematic view a detail of a part of the mechanism of the lock of FIG. 1.

As can be seen in FIGS. 3 and 4 a drive shaft gear 22 engages the rack 20. Thus rotation of the drive shaft gear 22 produces a corresponding linear movement in the rack 20. In turn, the drive shaft gear 22 is retained on an inner cylinder output shaft 24. The inner cylinder output shaft 24 is supported within an inner cylinder 26. Thus, rotation of the inner cylinder 26 produces a corresponding rotation in the inner cylinder output shaft 24 and, in turn, a rotation in the drive shaft gear 22 leading to the extension/retraction of the lock bolt 12 through rack 20 as described.

The inner cylinder 26 is supported inside the body of an outer cylinder 28. Further, during operation and control of the locking mechanism by electronic means the inner cylinder 26 is coupled to the outer cylinder 28 by a mechanism to be described herein below such that any rotation of the outside cylinder 28 results in rotation of the inside cylinder 26 and inner cylinder output shaft 24 which in turn rotates the drive shaft gear 22 to act on the rack 20 to thereby move the lock bolt 12.

The outer cylinder 28 incorporates an axial projection 30 located on an opposing side of the outer cylinder 28 to the drive shaft gear 22. The axial projection 30 carries a perimeter gear 32. The perimeter gear 32 meshes with at least one electric motor gear 34 driven by an electric motor 36. Thus in normal electronic operation of the lock 10, the rack 20 and lock bolt 12 are activated by the drive shaft gear 22 which is driven through the perimeter gear 32 acted on by the motor gear 34. As described the inner cylinder 26, outer cylinder 28 and associated perimeter gear 32 act together as a transmission where the force from the motor is transmitted to the rack 20.

The electric motor 36 is of the high torque geared type making any non-electrical rotation of motor gear 34 very difficult.

It can thus be seen that under control of the electric motor 36, the drive shaft gear 22 and the motor gear 34 are coupled and that the lock 10 is only operable in response to rotation of the motor gear 34. It will be realised that in order for the motor gear 34 to operate on the drive shaft gear 22 and therefore the lock bolt 12 as described it is necessary that the relative positions of the inner cylinder 26 and outer cylinder 28 be maintained during the lock/unlock operation.

However, the engagement of the inner cylinder 26 and outer cylinder 28 as described is able to be de-coupled to thereby override the electronic motor control of the locking process.

FIGS. 5–15 detail the manual operation of the lock 10 and show how the decoupling of the transmission is achieved. The Figures illustrate cross-sectionally the arrangement of the inner cylinder 26 and outer cylinder 28.

Figure 5:
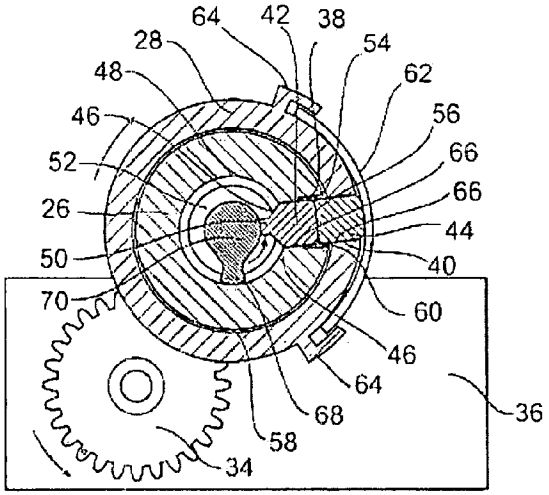
FIGS. 5–17 are sectional views of the preferred embodiment of this invention relating to the operation of the transmission means.

A radial aperture 38 extends through the wall of the inner cylinder 26 from an outer surface to an inner surface. Similarly, a radial aperture 40 in the outer cylinder 28 extends through the wall thereof from an outer surface to an inner surface. In the engaged condition, in which the motor 36 is coupled to the transmission, the apertures 38 and 40 are aligned as shown in FIG. 5. Inner and outer radial pins 42 and 44 located in the apertures 38, 40, maintain the relative alignment of the inner cylinder 26 and outer cylinder 28. The inner pin 42 has a tapered sidewall that allows it to lodge in the aperture 38. The inner pin 42 terminates in an abutment shoulder or taper 46 that forms a narrow shoulder portion 50 projecting into the bore 52 of the inner cylinder 26. Further, when the inner pin 42 projects into the bore 52 of the inner cylinder 26 as described a recess 54 is created behind the outer edge 56 of the pin 42. The depth of the recess 54, measured from an outer surface 58 of the inner cylinder 26 to the outer edge 56 of the inner pin 42 to form a protrusion distance 60.

The outer pin 44 is, as shown in FIG. 5 flush at its outer end 62 with the outer cylinder 28 and extends through the aperture 40 into the recess 54 behind the inner pin 42 contacting the inner pin 42 and thereby occupying the protrusion distance 60. A circumferential spring member 62 that extends partially around the circumference of the outer cylinder 28 biases the inner and outer pins 42, 44 into position. The spring 62 is secured at opposing ends in a pair of lugs 64 that are spaced around the outer cylinder 28. With no forces operating on the cylinders 26, 28 the spring 62 serves to maintain the pins 42, 44 in position. Because a portion of the outer pin 44 extends into the aperture 38 in the inner cylinder 26, that is, across the protrusion distance 60 the two cylinders 26,28 are locked into position.

Thus, during electric operation, rotation of the outer cylinder 28 in a clockwise direction causes a shoulder 66 of outer cylinder aperture 40 to abut the pin 44 causing it to rotate and that portion of the pin 44 in the aperture 38 in the protrusion distance 60 then acts on the inner cylinder 26 causing it to rotate in unison.

Within the bore 52 of the inner cylinder 26 a cam 68 abuts the shoulder 46 of the pin 42. The cam 68 is carried on a shaft 70 that is attached at one end to the thumb turn 18 and at a second end to the output drive shaft 24. Thus, the cam 68 rotates directly in response to either rotation of the thumb turn 18 or rotation of the key 16.

Figure 6:
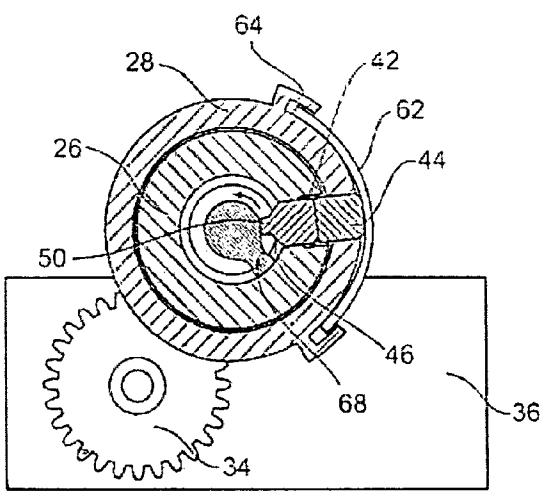

In FIG. 6 manual operation of the lock 10 occurs when insertion and rotation of a key 16 or rotation of a thumb turn 18 in an anti clockwise direction causes the cam 68 to move in an anti clockwise direction until it is moved into abutment with shoulder 46 of pin 42.

Figure 7:
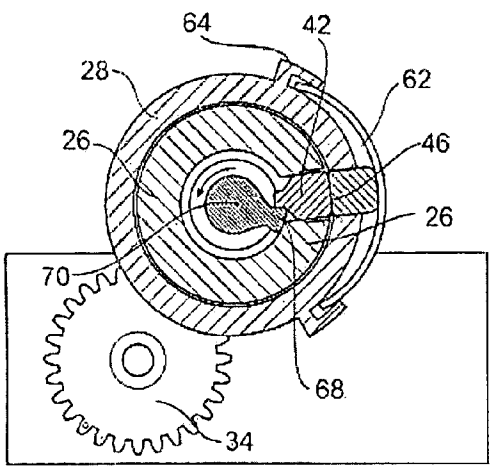
Figure 8:
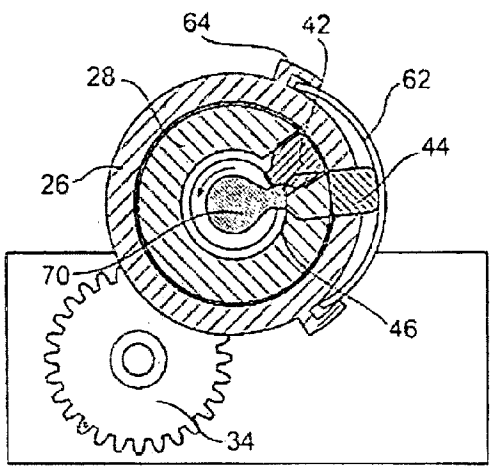

Operation of the cam 68 causes the pin 42 and consequently the pin 44 to move radially away from the centre of the inner cylinder 26 against spring 62 as shown in FIG. 7. The spring 62 flexes outwardly from the outer cylinder 28 under force from the pins 42, 44. As can be seen in the drawing the pins 42, 44 move radially outwardly through the protrusion distance 60 such that the point at which the pins 42, 44 abut one another eventually aligns with the outer edge 58 of the inner cylinder 26. At this point the inner cylinder 26 and outer cylinder 28 become rotationally de-coupled because of the movement of the outer pin 44. Thus any rotational force applied from the cam 68 is now translated directly into rotation of the inner cylinder 26 without any corresponding rotation of the outer cylinder 28.

The disengagement of the inner cylinder 26 and outer cylinder 28 effectively decouples the operation of the lock bolt 12, which is influenced by rotation of the inner cylinder 26 through the output drive shaft 24 and the drive shaft gear 22, from the motor gear 34 which is influenced by rotation of the outer cylinder 28 through the perimeter gear 32.

Therefore, rotation of the inner cylinder 26 now produces a corresponding rotation of the drive shaft 24 and drive shaft gear 22 and consequently the rack 20. Accordingly, the lock bolt 12 is extended and retracted in response to manual turning of the thumb turn 18 and key 16.

Figure 9:
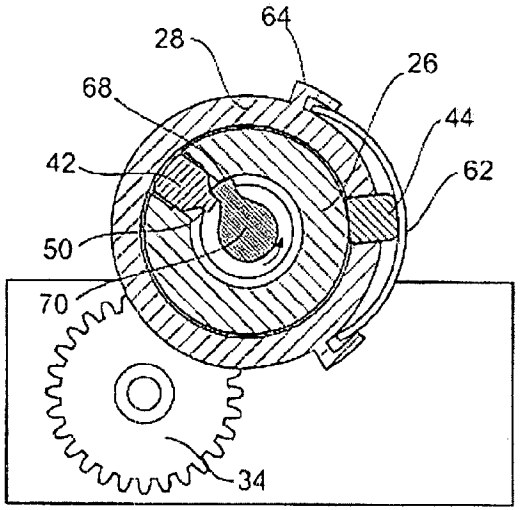
Figure 10:
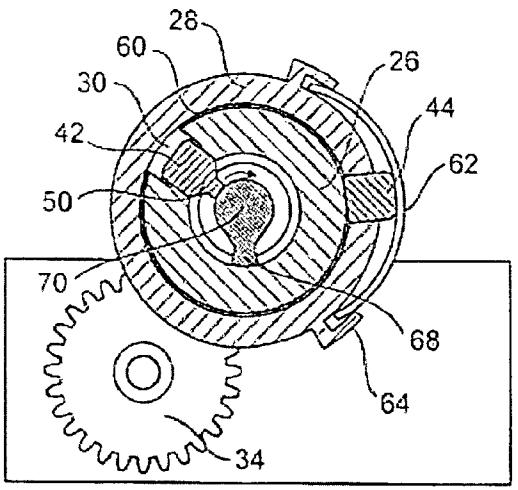
Figure 11:
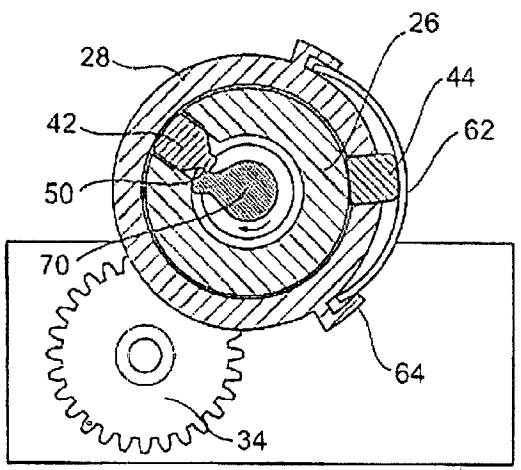
Figure 12:
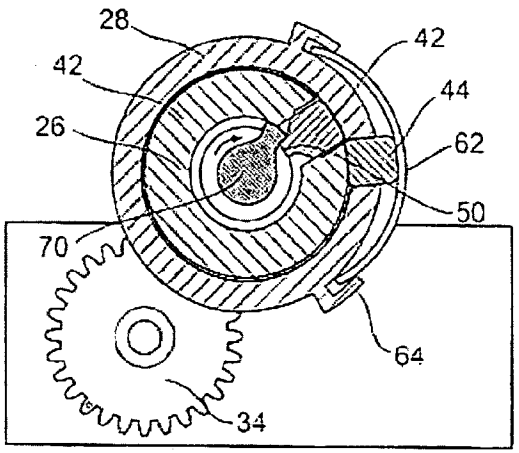
Figure 13:
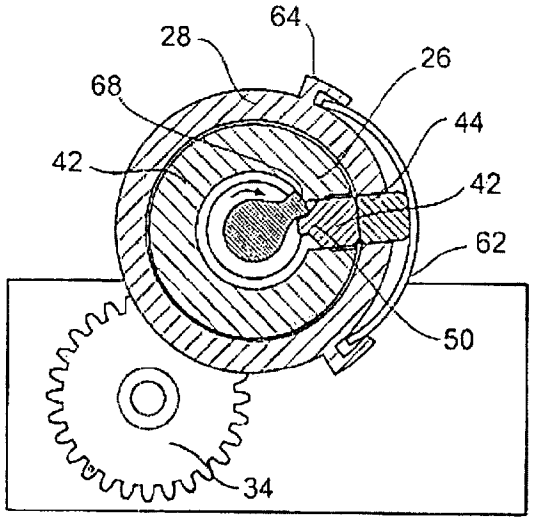

In FIGS. 5 to 9 an anticlockwise direction for rotation of the key 16 or thumb turn 18 is shown. However it is to be understood that either anti clockwise or clockwise rotation of the key will effect a disconnection of the electric motor gear 34. In FIG. 9 the cam 68 has been rotated to the point where it meets and bears against the shoulder 50 of the inner pin 42. The shoulder 50 limits the travel of the cam 68. This position represents the outer limit of deadbolt movement. The limits of movement of the inner cylinder 26 is thus limited by the movement of the deadbolt 12.

In FIGS. 10 to 13 the interlocking of outer cylinder 28 and inner cylinder 26 is re-established by rotating the thumb turn 18 or key 16 in an opposite direction to the rotation that effected a disconnection of the engagement between the two cylinders.

The effect of rotation of the thumb turn 18 or key 16 in a clockwise direction on the relative positions of the two cylinders 26, 28 and the pins 42, 44 is shown in these Figures. As will also be appreciated the rotation of the thumb turn 18 or key 16 in a clockwise direction also causes a retraction in the lock bolt 12 thereby causing an unlocking action.

Figure 14:
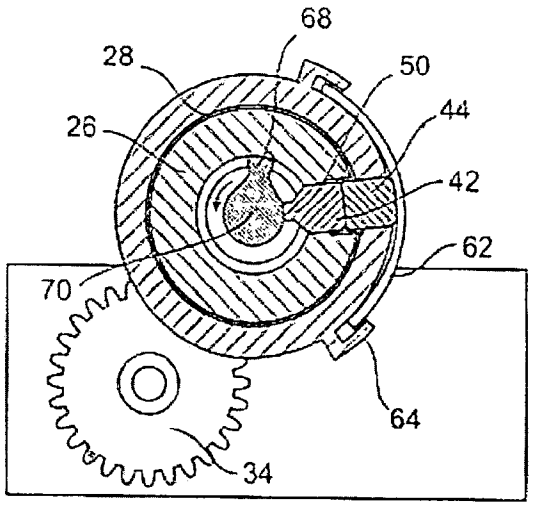
Figure 15:
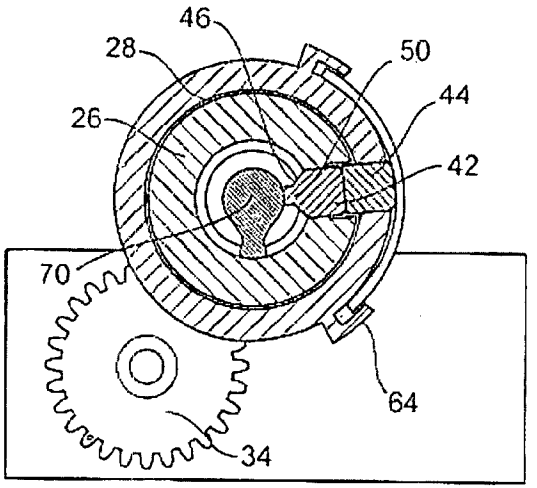

As the lock is rotated the inner cylinder 26 is moved back to the re-lock position, the inner pin 42 is moved into alignment with the outer pin 44 allowing the spring 62 to bias the pin 44 downwards radially toward the centre of inner cylinder 26 and back into engagement with the inside cylinder aperture 38 as shown in FIG. 14. As shown in this position the inner and outer cylinders 26, 28 are now re-engaged and accordingly, rotation of the motor gear 34 now induces a corresponding rotation in the outer cylinder 28 and hence the inner cylinder 26 and ultimately the lock bolt 12. That is, the lock 10 is now under electrical control rather than manual control.

It is important to realise that the electrical control of the operation of the lock 10 of the present invention can be instituted and can override the manual operation of the lock at any point in the locking/unlocking cycle.

An advantage of this arrangement is that the lock 10 may be operated with the key 16 to disconnect the electric motor and operate the lock bolt 12 but may be reset either with the use of a the key 16 or thumb turn 18, or by operation of the electric motor.

This allows the lock to be manually operated and then automatically reset when the next electrical lock command is given.

Figure 16:
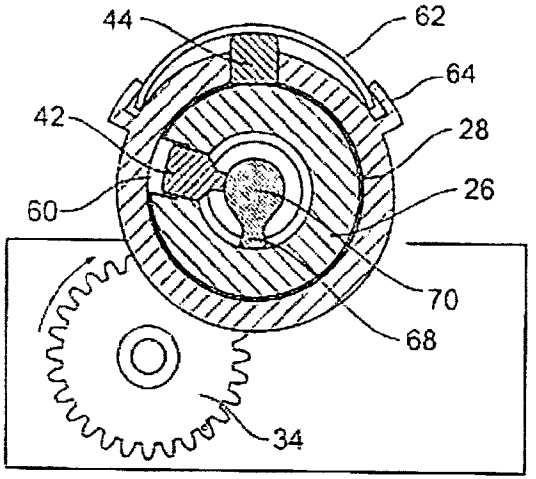
Figure 17:
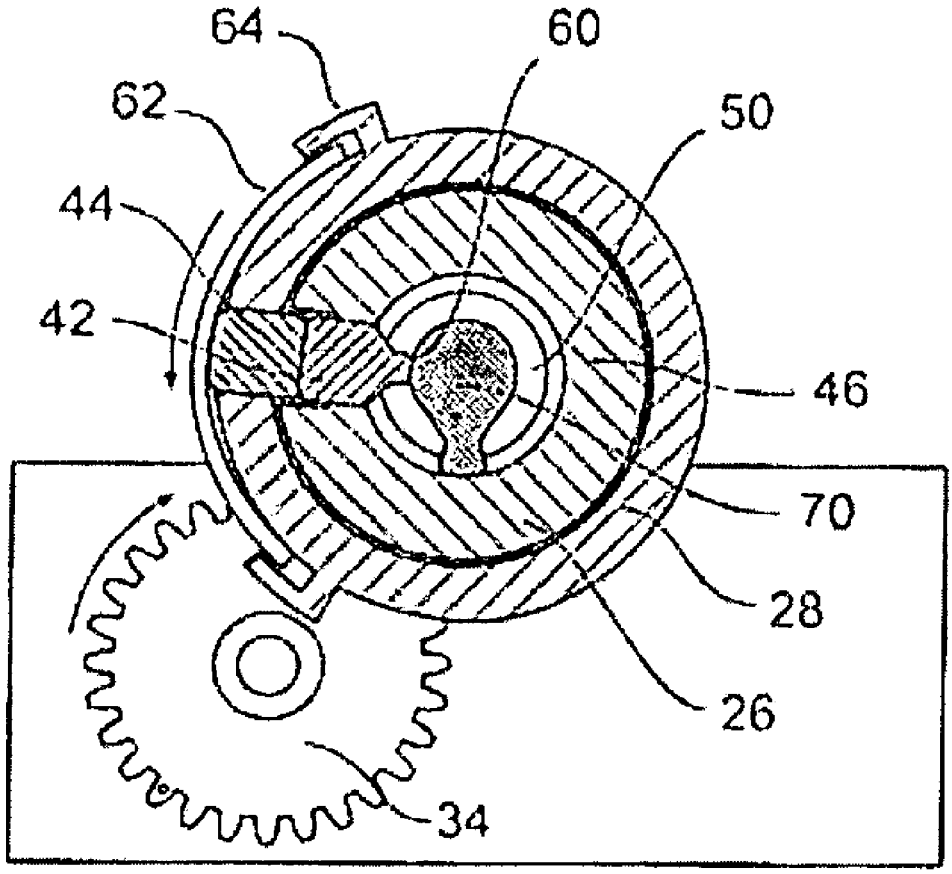

Thus, as illustrated in FIGS. 16 and 17 the lock 10 in FIG. 16 is in a disengaged position but is intermediate between the locked and unlocked positions. In this case re-engagement occurs by rotation of the outer cylinder 28 until the outer pin 44 is aligned with the inner pin 42 to effect the re-engagement as shown in FIG. 17. The arrangement of the lock 10 is such that the permitted range of movement of the outer cylinder 28 is greater than the movement of the inner cylinder 26 ensuring that the motor 36 can always be re-engaged irrespective of the position of the lock 10 when the motor 36 is operated.

The above mode of operation may be of use if one imagines a situation in which manual operation of the lock has been initiated because of a temporary misplacement of a remote electronic opening device. Should the device be located and activated this will not have any adverse affect on the lock if manual operation is partially complete. The motorised operation of the lock will simply take over from the manual operation.

The lock of the invention has been described with reference to a lock having a generally cylindrical transmission in the form of the inner and outer cylinders. In further embodiments of the invention the lock may be exemplified in the form of a linear transmission in which engaging members move relative to one another.

It is to be understood that when under manual operation of the lock the inner and outer cylinders have been disengaged or decoupled, it would require a fair bit of precision to align the cylinders again for them to couple. Accordingly, it may be desirable for the manual thumb turn or key to always be biased to a first position and hence, the cylinders being coupled by the operation of the electric motor driving the outer cylinder until the cylinder apertures align and the pin drops down.

Figure 18:
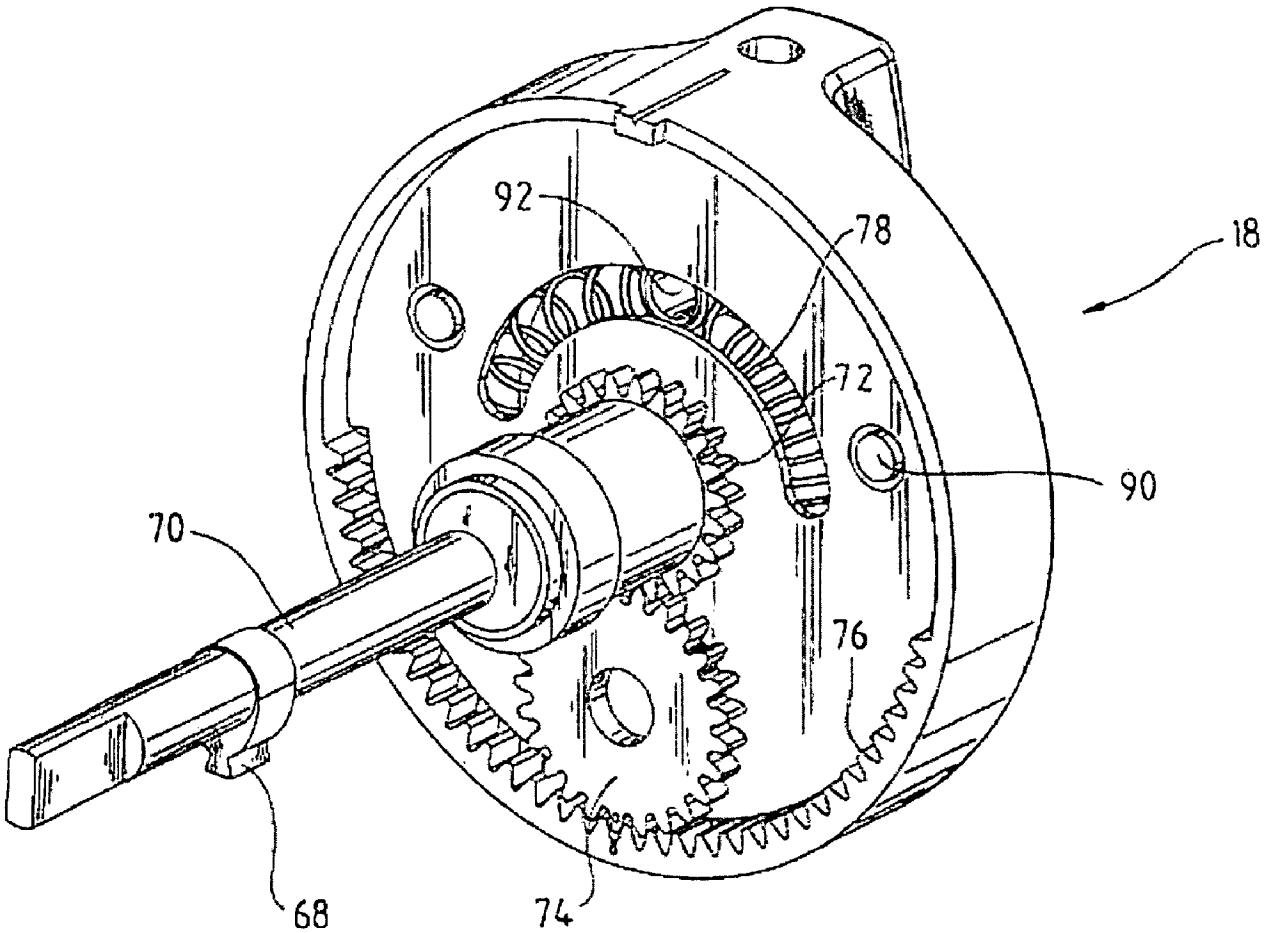
FIG. 18 is a perspective view of a thumb turn according to a second aspect of the invention.
Figure 19:
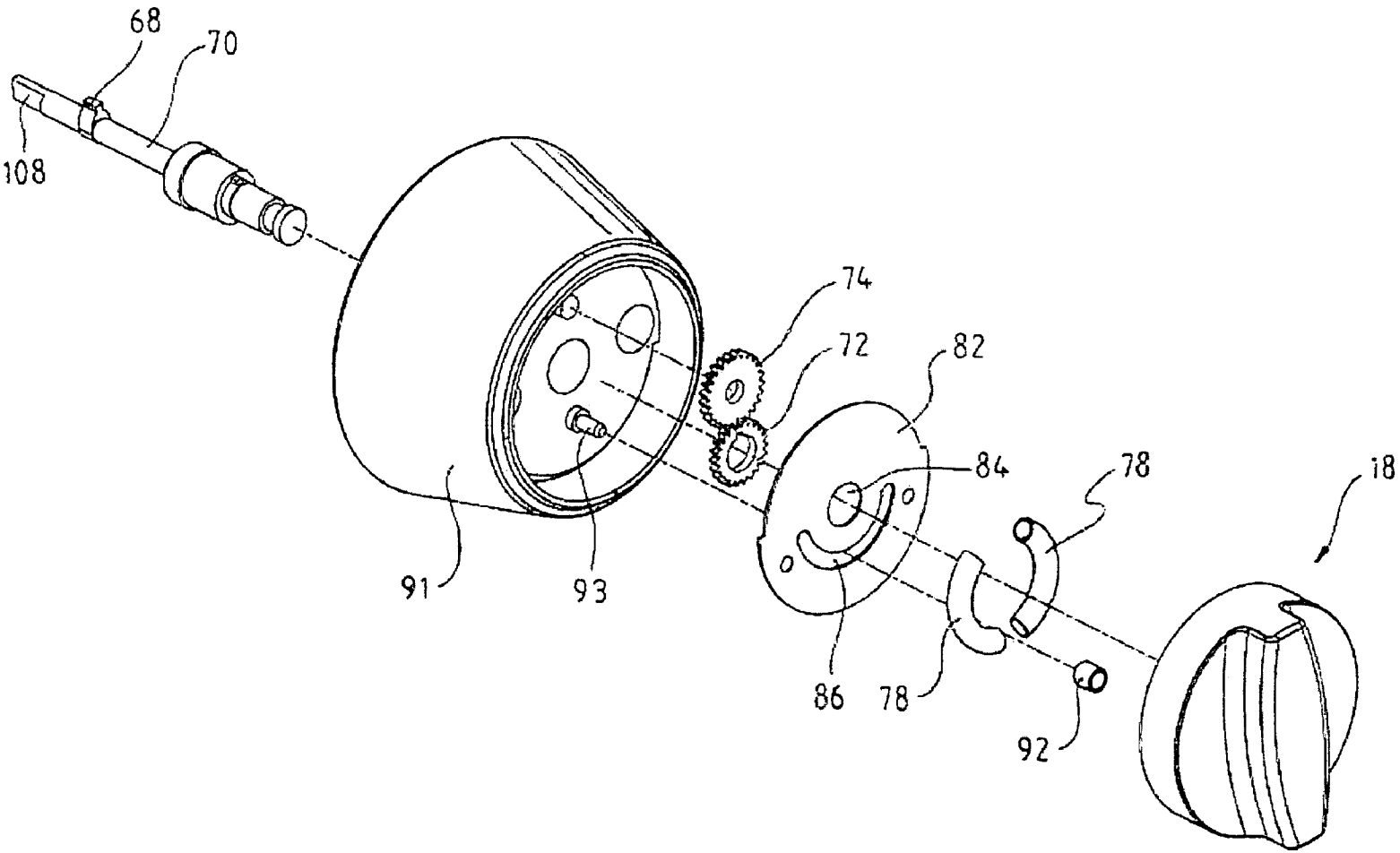
FIG. 19 illustrates the thumb turn of FIG. 18 in exploded view.

In a further aspect of the invention and as illustrated in FIGS. 18 and 19 the thumb turn 18 is geared to amplify the rotational motion of the shaft 70 with respect to the rotation of the thumb turn 18. Accordingly drive shaft 70 includes a driving gear 72 meshed with intermediate gear 74 that is in turn driven by thumb turn gear 76 located on the inside of the thumb turn 18. Due to the relative dimensions of the gears, rotation of the thumb turn through an angle translates into rotation of the drive shaft though a much greater angle, typically doubled. The thumb turn 18 is biased to a central position. This biasing in this particular embodiment is achieved by using compression springs 78 housed within angular cavity within thumb turn 18. Plate 82 encloses cavity 80 and includes a central aperture 84 for the passage of shaft 70 therethrough, slit 86 correspondingly shaped to the cavity to enable for observation of the springs 78, the width of the slit 86 being smaller than the springs. Bores in plate 82 fit over locating pins 90 in the thumb turn 18. The whole arrangement is then housed within a case 91 that is bolted to a door. The case also includes a locating pin 93 or other arrangement that positionally holds bush 92 located in the cavity and separating the two springs 78. Since the bush 92 remains in fixed position, rotation of the thumb turn 18 causes one of the springs to be compressed between the shoulder end of the cavity and the bush 92, rotation of the thumb turn 18 in the opposite direction obviously compressing the other spring.

In a further aspect of the invention there is provided a key bypass mechanism that enables the lock to be unlocked in case the electric motor fails with the lock being locked or in an intermediate position.

Figure 20:
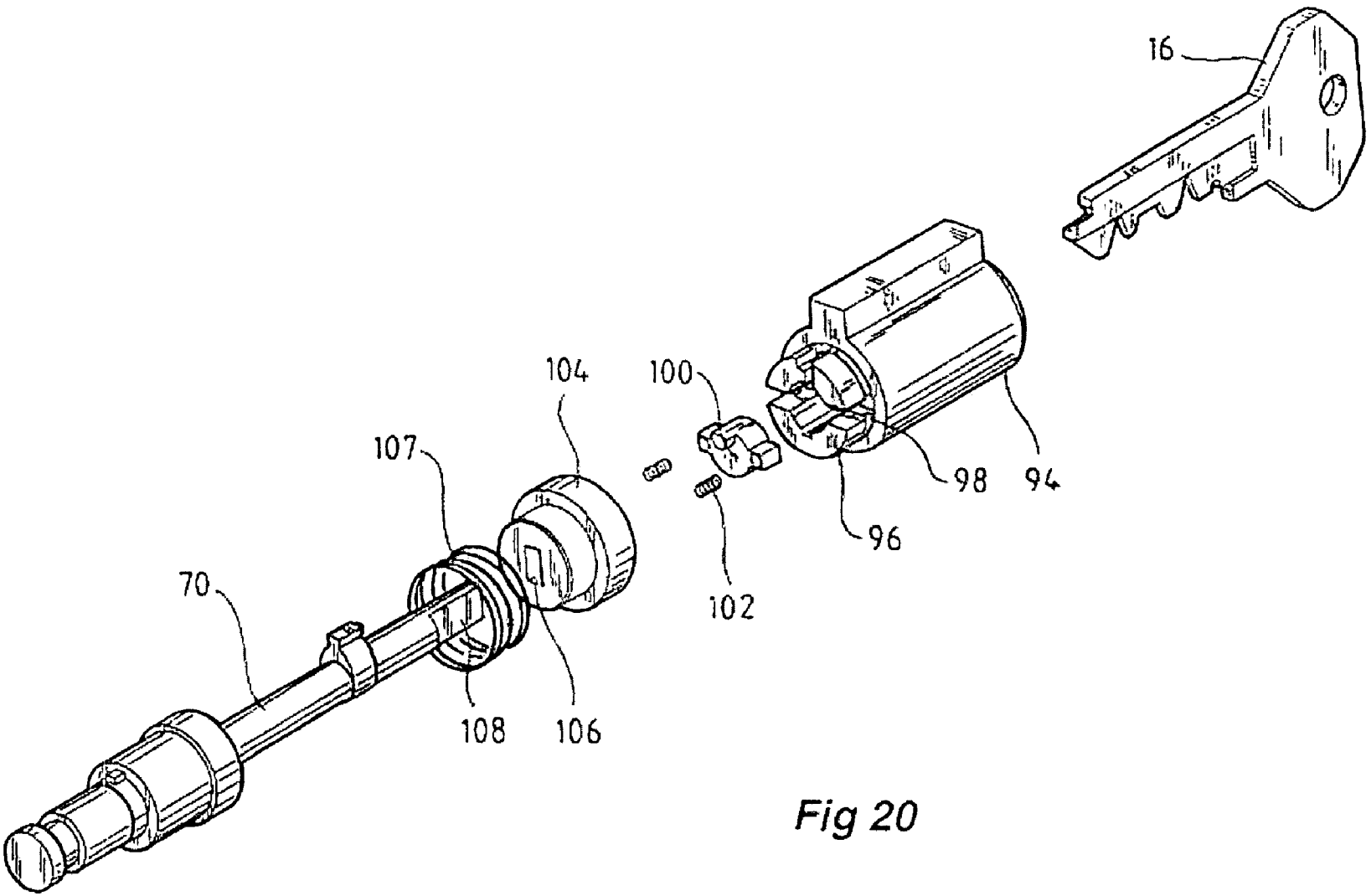
FIG. 20 is an exploded view of the key lock according to a further aspect of the invention.
Figure 21:
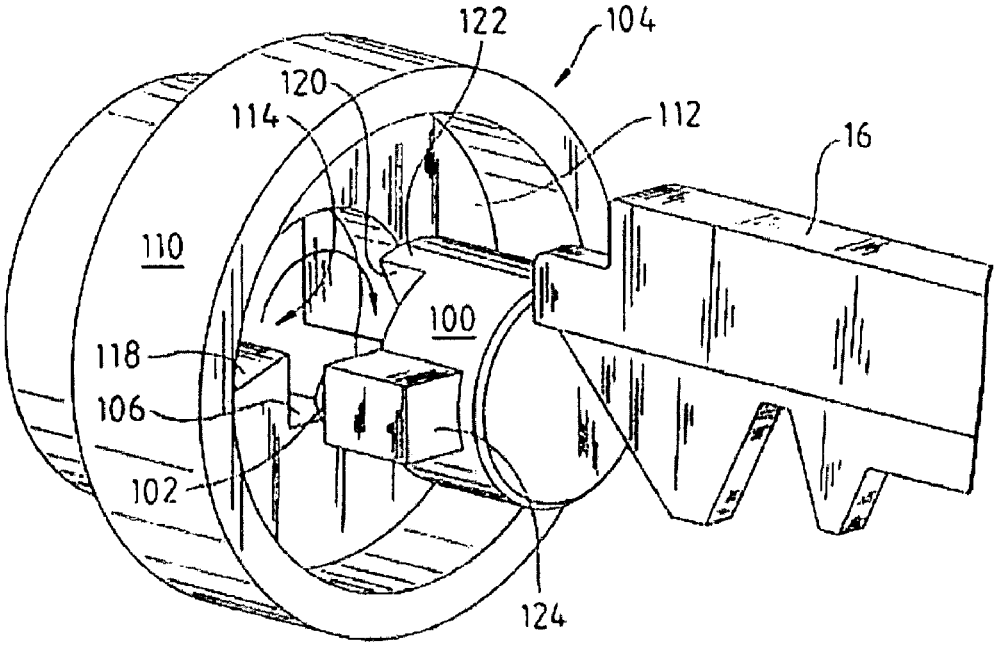
FIG. 21 is a partial perspective view of the key lock before engagement by a key.
Figure 22:
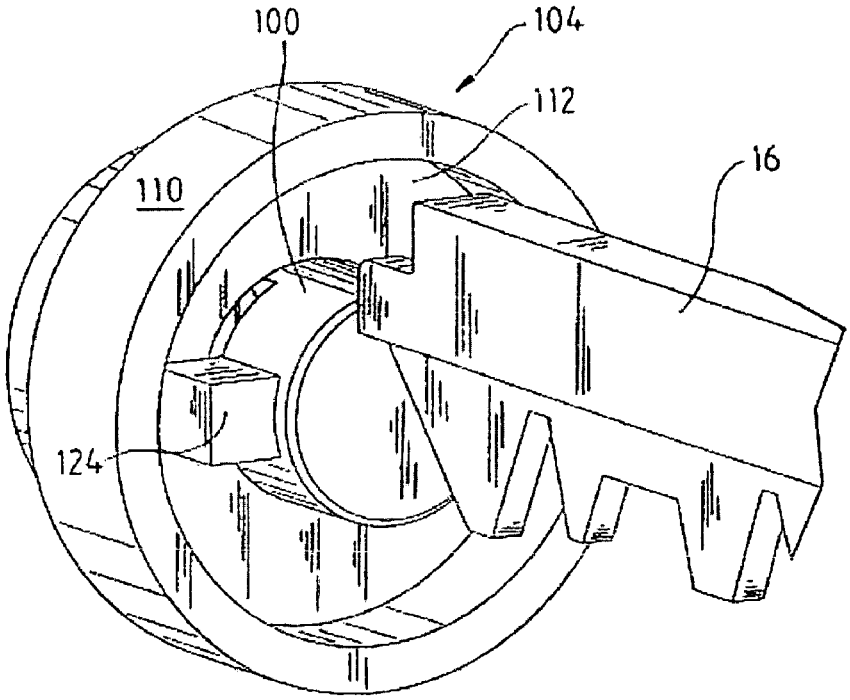
FIG. 22 is the view as in FIG. 21 after the key has engaged the lock.

Referring specifically to FIGS. 20 to 22, key 16 is inserted into lock barrel 94 the end of lock barrel 94 including a rotatable driver 96 including a groove 98 within which is located a connector 100, the connector 100 biased within groove 98 by the use of springs 102. A rotational coupling element 104 includes a rectangular groove 106 adapted to engage and rotatingly lock correspondingly shaped end 108 of drive shaft 70. Coupling element 104 includes an outer wall 110 and base 112 through which extends the groove 106. Base 112 also includes a partially circular cavity 114 whose angular extent is equal to or greater than the total effective rotation of the drive shaft able to be driven by the electric motor 36. The cavity 114 includes end shoulders 118 that are adapted to be engaged by shoulders 120 of projection 122 of connector 100.

In one instance, by virtue of the size and shape of cavity 114, projection 122 can always be inserted into the cavity 114, regardless of the state of the lock 10. Rotation of key 16 then causes one of the shoulders 120 or projection 122 to engage corresponding shoulder 118 in the cavity thereby rotating the coupling element 104 and hence shaft 24.

Springs 102 are held within lugs 124 of connector 100 that are positioned so that the springs always abut against the base 112. The skilled addressee should now appreciate that the key has to be used to press the connector 100 to that the projection 122 engages within cavity 114.

In another instance, however, it may be that the cavity is not sufficiently large and accordingly the coupling element 104 is longitudinally biased using spring 107 so that the whole coupling element 104 can move longitudinally forward to enable the key to be fully inserted into the barrel 94 to operate the lock. Then upon rotation of the key, the projection eventually align with the cavity at which point the rivet means returns to its biased position.

Figure 23:
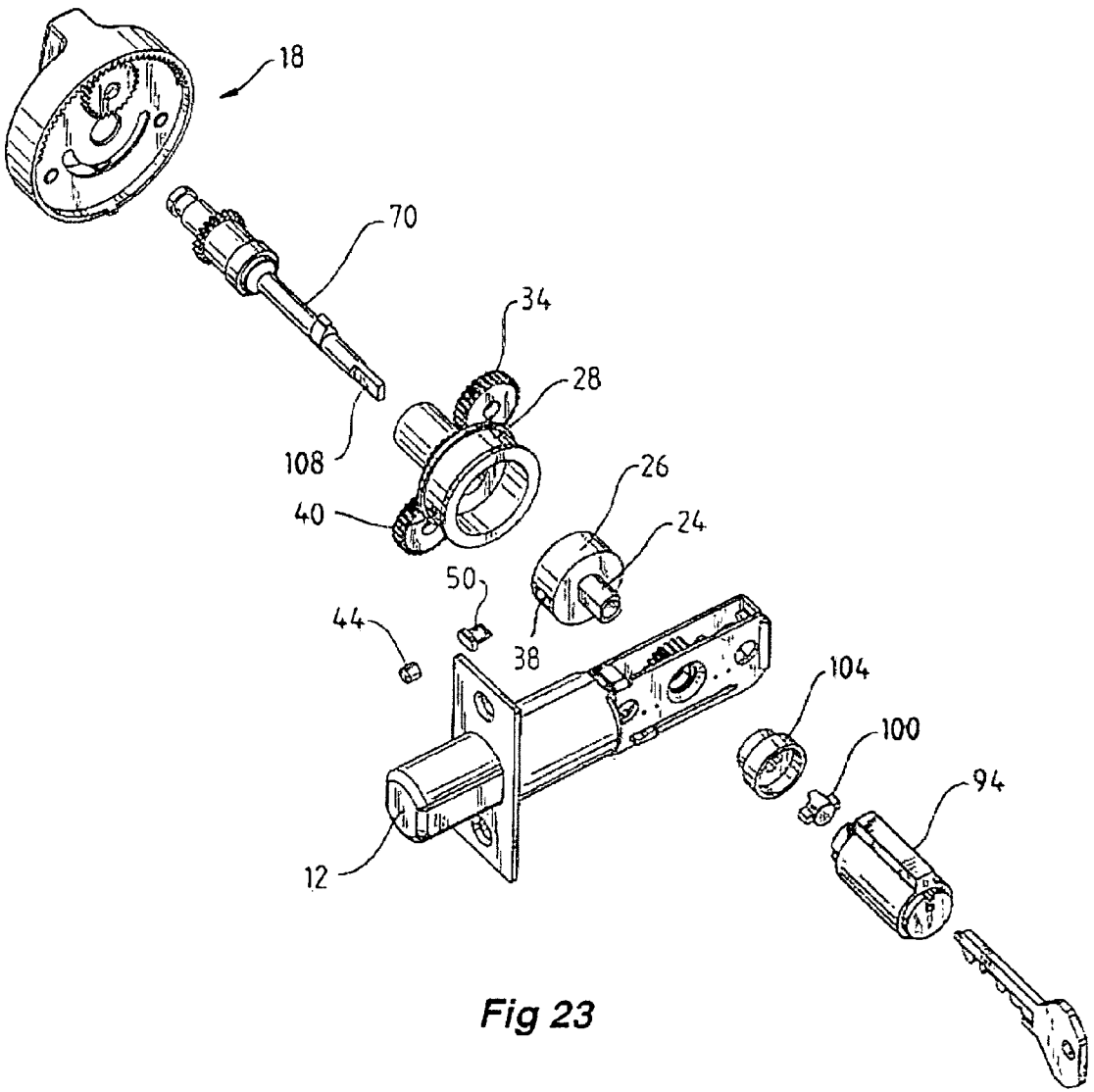
FIG. 23 illustrates in perspective exploded view a lock embodying the various aspects of the present invention.
Figure 24:
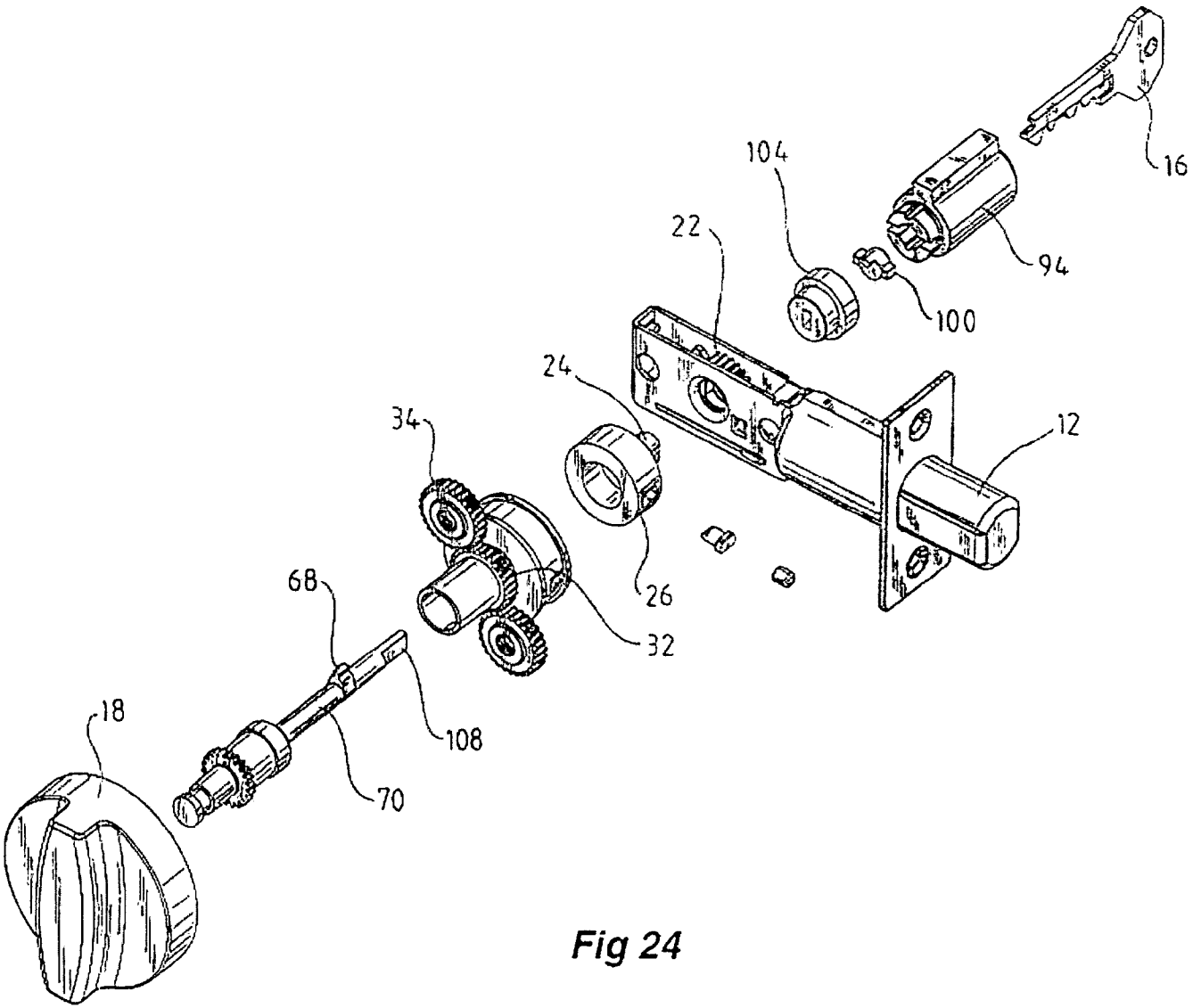
FIG. 24 illustrates an alternate perspective exploded view of the lock of FIG. 23.

FIGS. 23 and 24 illustrate an exploded view of embodying the new aspects of the invention Including the fact that there are now two motor gears 34 driven by two motors thereby increasing the torque available to drive the lock.

The invention has been described by way of example. The examples are not, however, to be taken as limiting the scope of the invention in any way. Modifications and variations of the invention such as would be apparent to a skilled addressee are deemed to be within the scope of the invention.

It is to be understood that the clutch mechanism as described above may be used with different types of thumb turns and key barrel lock arrangement and it is not intended to limit the invention to the embodiment as described above.

It is also to be understood that the mechanical stroke or angular rotation is always less than the electronic stroke or rotation to enable the clutch mechanism to be reset after a key has operated the lock.

In principle what one can do is turn the thumb turn to disconnect the transmissions to open the lock manually, shut the door behind them and then electronically operate the lock to lock it.

Electronic micro switches may be included in the lock bolt to sense the true position of the lock bolt for lock monitoring and control.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. An electronic deadbolt lock arrangement including:

a lock having a bolt movable between locked and unlocked conditions, the lock having a manual control means serving to operate the lock between said locked and unlocked conditions:

a power drive coupled by a transmission to the manual control means whereby the lock is operated between the locked and unlocked conditions in response to operation of the power drive;

a transmission means coupling the manual control means and the power drive whereby the lock moves between said locked and unlocked conditions;

the transmission means operable to decouple the power drive from the manual control means to enable the lock to be operated by the manual control means independently of the power drive, said transmission means includes an inner and outer concentric rotatable cylinders, the two cylinders are biased into a coupled position by biasing means and are decoupled by a centrally located cam acting on a pin engaging mechanism urging a pin out of engagement with at least one cylinder to thereby decouple the cylinders.

2. An electronic deadbolt arrangement as in claim 1 wherein said manual control means is a thumb turn.

3. An electronic deadbolt arrangement as in claim 1 wherein said manual control means is a key.

4. An electronic deadbolt arrangement as in claim 1 wherein said power drive is an electric motor.

5. An electronic deadbolt arrangement as in claim 1 wherein said inner and outer cylinders may be coupled and de-coupled by said pin extending from one cylinder engaging an aperture in the other cylinder.

6. An electronic deadbolt arrangement as in claim 5 wherein said pin extends from and is biased from said outer into said inner cylinder.

7. An electronic deadbolt arrangement as in claim 6 further including an element adapted to engage said pin, said element operable by a cam to move the pin out of said inner cylinder to cause a decoupling thereof.

8. An electronic deadbolt arrangement as in claim 7 wherein said cam is mounted on a drive shaft passing axially through said cylinders.

9. An electronic deadbolt arrangement as in claim 1 wherein said inner cylinder is connected to a rack and gear mechanism whereby rotation of the inner cylinder serves to move said bolt between locked and unlocked positions, said outer cylinder is operatively connected to a motor serving as a power drive that rotates the outer cylinder.

10. An electronic deadbolt arrangement as in claim 1 wherein there are two or more manual control means.

11. An electronic deadbolt arrangement as in claim 2 wherein said thumb turn is coupled through a transmission to a rotatable shaft, said transmission multiplying the relative rotation of the thumb turn applied to the shaft.

12. An electronic deadbolt arrangement as in claim 3 wherein said key operates a lock barrel, said lock barrel operatively connected to the bolt through a coupling enabling the key to operate the bolt only when fully inserted into said lock barrel.

13. An electronic deadbolt arrangement as in claim 12 wherein said coupling includes a biased connector adapted to engage a coupling element, said element operatively connected to said bolt.

14. An electronic deadbolt arrangement as in claim 13 wherein said connector includes a cavity adapted to be engaged by a projection of said connector, the cavity of a size and shape to be engageable by said projection regardless of the relative rotational position of said connector and said coupling element.

* * * * *